US005975324A

United States Patent [19]

Schmitt

[11] Patent Number: 5,975,324

[45] Date of Patent: Nov. 2, 1999

[54] FOLDING CONTAINER

[75] Inventor: Peter Schmitt, Burbach, Germany

[73] Assignee: Gebr. OTTO KG, Kreuztal, Germany

[21] Appl. No.: 09/101,981

[22] PCT Filed: Jan. 16, 1997

[86] PCT No.: PCT/EP97/00168

§ 371 Date: Jul. 20, 1998

§ 102(e) Date: Jul. 20, 1998

[87] PCT Pub. No.: WO97/26193

PCT Pub. Date: Jul. 24, 1997

[30] Foreign Application Priority Data

Jan. 18, 1996 [DE] Germany ..... 196 01 678
Apr. 22, 1996 [DE] Germany ..... 196 15 885

[51] Int. Cl.[6] ..... B65D 7/24

[52] U.S. Cl. ..... 220/6; 220/1.5

[58] Field of Search ..... 220/6, 7, 1.5

[56] References Cited

U.S. PATENT DOCUMENTS 3,874,546 4/1975 Sanders et al. ..... 220/6
4,300,695 11/1981 Hsu ..... 220/6
4,674,647 6/1987 Gyenge et al. ..... 220/6
4,917,255 4/1990 Foy ..... 220/4 F

FOREIGN PATENT DOCUMENTS 9 101 566 U 5/1991 Spain .
2 063 220 6/1981 United Kingdom .

*Primary Examiner*—Steven Pollard
*Attorney, Agent, or Firm*—Milton Oliver; Ware, Fressola, Van Der Sluys & Adolphson LLP

[57] ABSTRACT

The invention relates to a folding container with four vertical side walls (2, 3) that are hinged to a baseplate (1) and can each pivot inward into a horizontal position. Two opposing side walls partially overlap each other in their horizontal position and the overlapped region of the side wall lying underneath has projections and recesses (21, 22) on its upper side and the overlapping region of the side wall lying above is correspondingly shaped on its underside, in such a way that the total thickness of the two regions overlapping each other corresponds to the thickness of one side wall.

20 Claims, 5 Drawing Sheets

FOLDING CONTAINER

FIELD OF THE INVENTION

The invention relates to a folding container with four vertical side walls that are hinged to a baseplate. Each of the side walls can pivot inward into a horizontal orientation.

BACKGROUND

It is known to fold two vertical side walls on the narrow sides of a folding container inward along the horizontal hinge axis at the bottom until they rest on the bottom plate. Then the two side walls of the long sides are folded inward over them. In the erected state or configuration, the side walls of the narrow sides rest against a vertical catch strip on the edge of the other side walls. This catch strip protrudes inward and after the side walls of the long sides are folded into the upright position, the side walls of the narrow ends rest against the catch strip with positive fit.

More often than not, the two side walls of the long sides have a height that is greater than half the width of the bottom plate so that they lie on top of each other and as a result, increase the overall height of the container when in the collapsed position.

SUMMARY OF THE INVENTION

An object of the invention is to improve a folding container of the type mentioned at the beginning so that with a simple construction, low consumption of materials, and small dimensions, the height of the side walls lying on top of one another is low in the overlapping region, without significantly reducing the stability of the side walls.

Another object of the invention is to provide a sufficiently large, in particular continuously extending, support surface for the upper horizontal stacking rim on the overlapping side walls, on which stacking rim the container disposed above this one rests.

These objects are attained according to the invention by virtue of the fact that two opposing side walls partially overlap each other in their horizontal orientation, and the overlapped region of the side wall lying underneath has projections and recesses on its upper side, and the overlapping region of the side wall lying above is correspondingly shaped on its underside, in such a way that the total thickness of the two regions overlapping each other corresponds to the thickness of one side wall.

In the overlapping region, this produces an overall height of the two overlapping side walls that is equal to the height or thickness of one side wall or is only insignificantly higher or thicker. The stability of the side walls is maintained and the container disposed above this one is offered a sufficiently large support surface.

A particularly high stability and a low height are achieved if the two regions engage in each other with positive fit.

It is particularly advantageous if the projections are strip-shaped and rest in pocket-shaped and/or slot-shaped cavities, in particular recesses, on the other side wall. When the side wall is erected vertically, the projections on the upper horizontal (end face) edge (25) of the side wall can constitute horizontal support surfaces for a container disposed above this one.

This makes a continuous stacking rim possible. The container rim is so formed that in the region of the upper rim, the lower side wall has been recessed by one wall thickness, and, inside the stacking rim, has a pocket-shaped, continuous recess pointing toward the container bottom. Support ribs that support the stacking rim are introduced partway into this recess.

On the side wall which is folded in second, the pocket is correspondingly formed toward the outside (pointing upward) and supports the stacking rim with support ribs that are directed inward or point downward. Now the stacking rims are inserted into the respective pockets. The support ribs are inserted into corresponding recesses in the stacking rim and in the stack boundaries. It is consequently achieved that a stacking rim can be formed that is laterally defined over nearly the entire depth of the wall, and it is nevertheless possible for side walls to overlap.

Therefore it is also proposed that support ribs (26) are disposed between the projections, extending laterally in relation to them. When the side walls are resting on top of each other, these support ribs rest in slots formed in the projections, particularly the strips of the other side wall.

So that in the collapsed state or configuration, the protruding lateral catch strips of the side walls do not increase the height, it is proposed that on the vertical edge of an erected side wall, a vertical catch strip projects inward. The vertical outside edge of the neighboring side wall comes into contact with the inside of this vertical catch strip. It is also proposed that the catch strip is disposed offset in relation to the vertical edge in such a way that the catch strip forms a space in relation to the vertical edge and this space corresponds to at least the wall thickness of the catch strip. In this instance, in the collapsed configuration, a catch strip of the opposing side wall can rest in the space formed by the catch strip. The bottom plate should also have recesses for the catch strip(s) in the collapsed position.

BRIEF FIGURE DESCRIPTION

Exemplary embodiments of the invention will be described in detail below and details of them are represented in the drawings.

Figure 1:
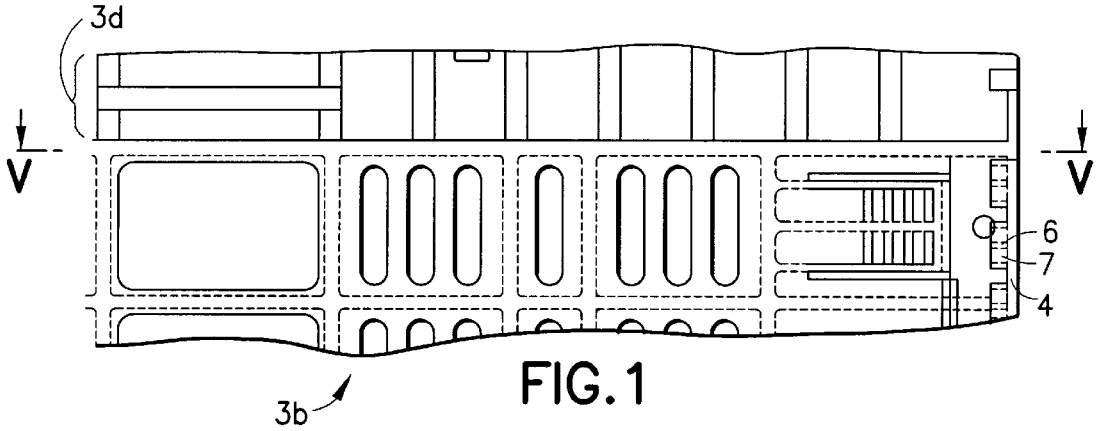
FIG. 1 shows the top side of the side wall lying on top.
Figure 2:
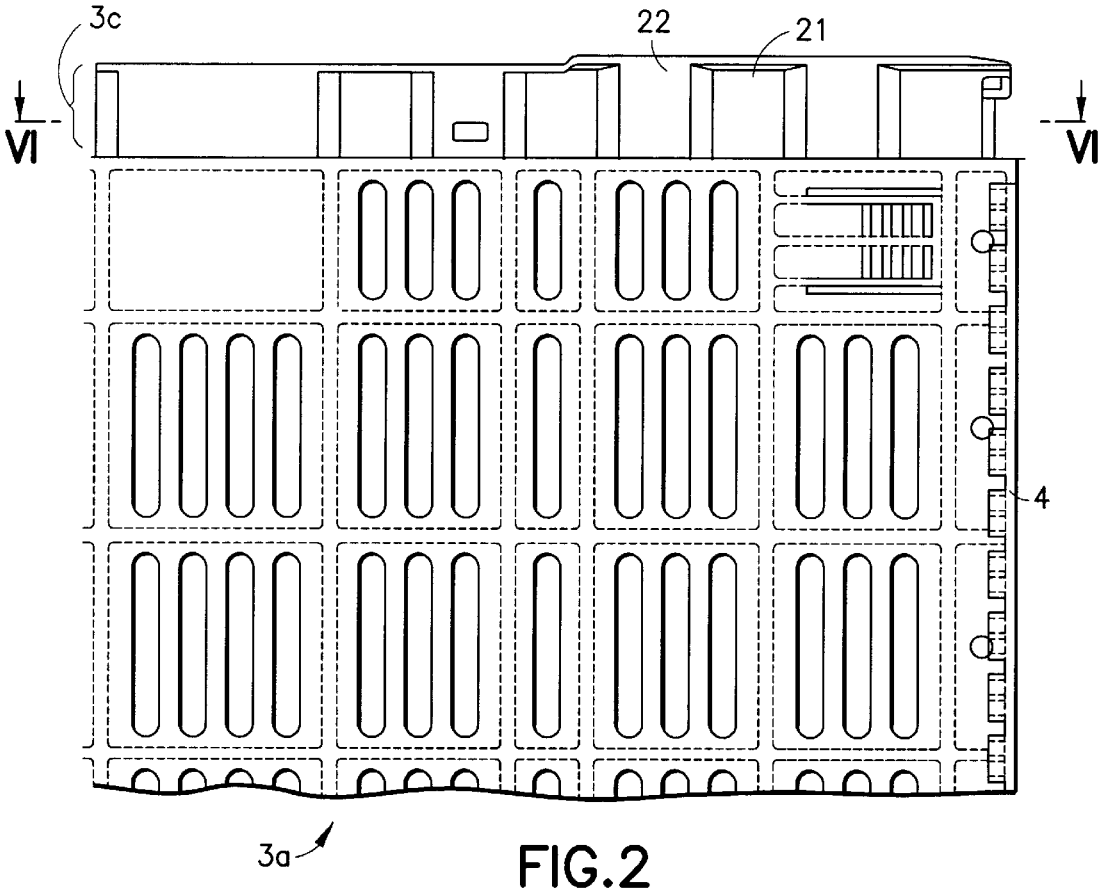
FIG. 2 shows the top side of the side wall lying underneath.
Figure 3:
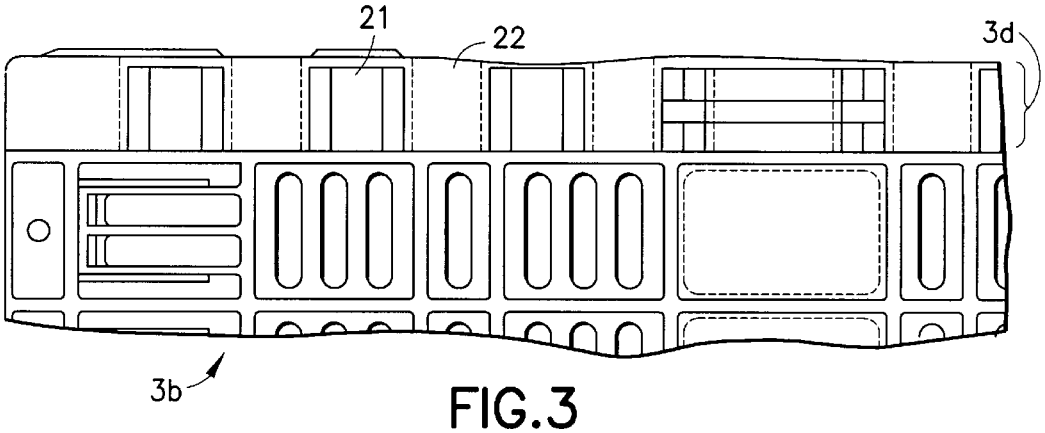
FIG. 3 shows the underside of the side wall lying on top.
Figure 4:
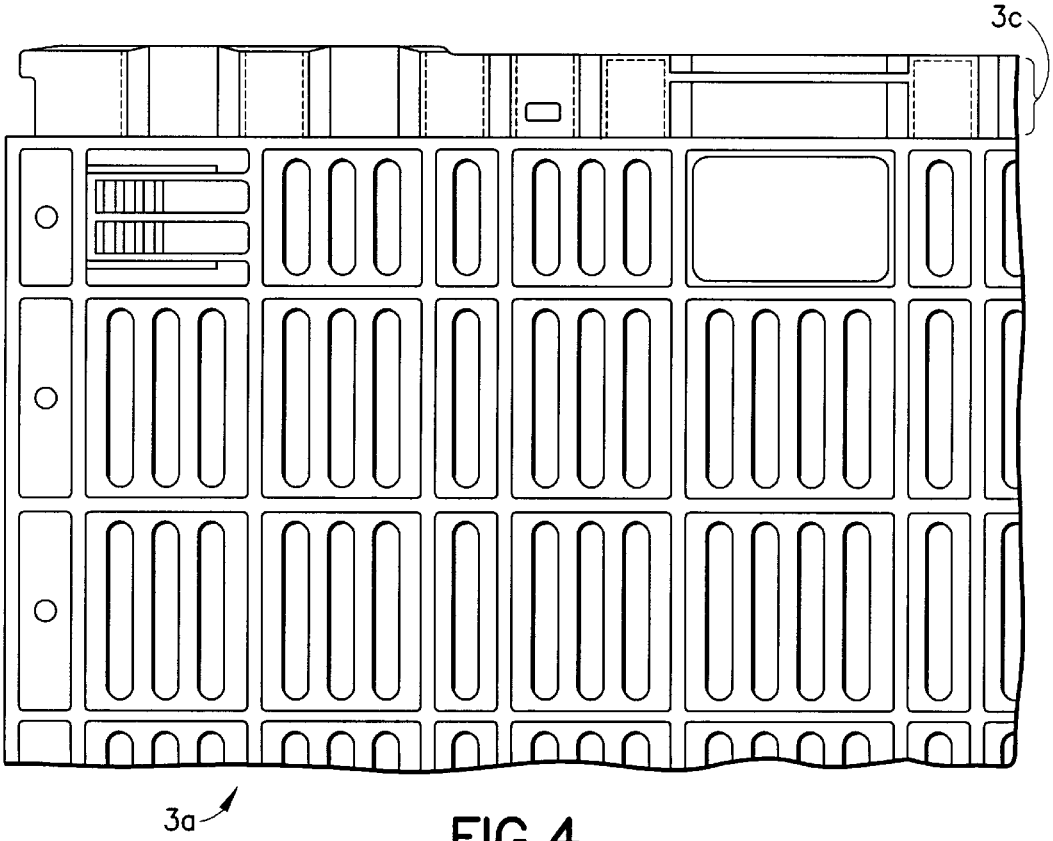
FIG. 4 shows the underside of the side wall lying underneath.
Figure 5:
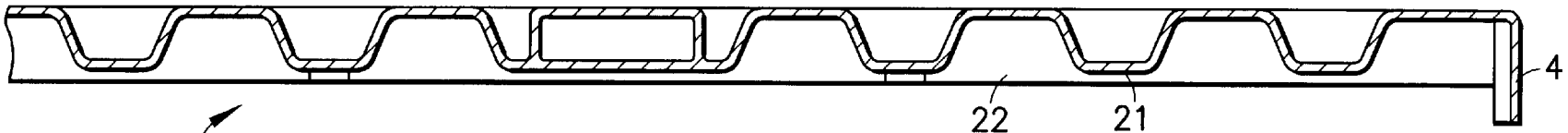
Figure 6:
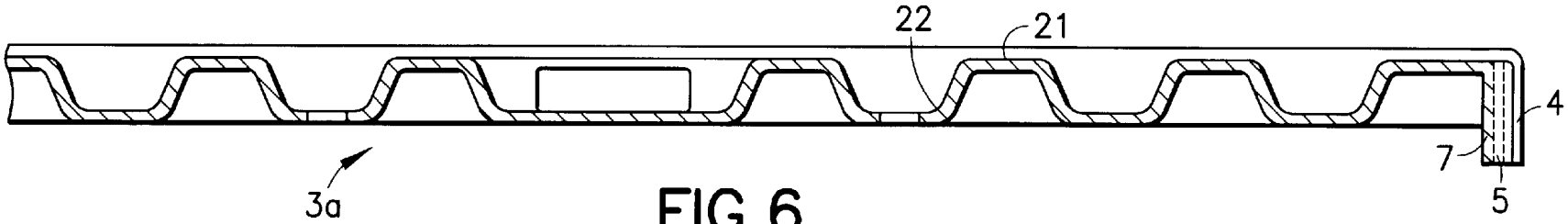
Figure 7:
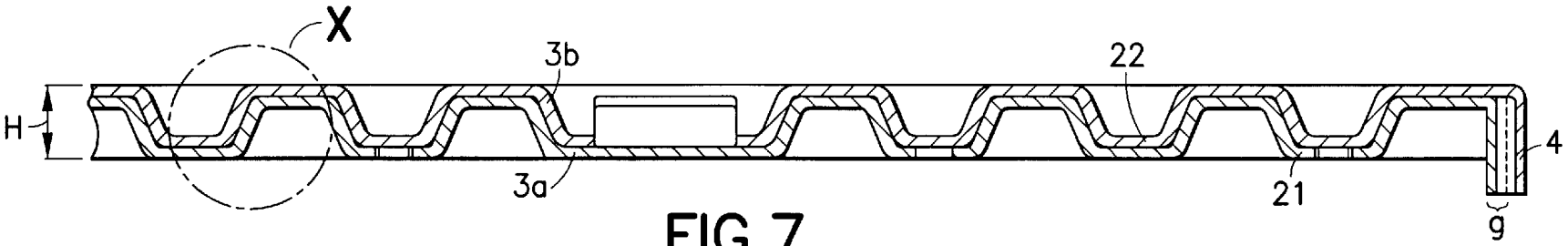
Figure 8:
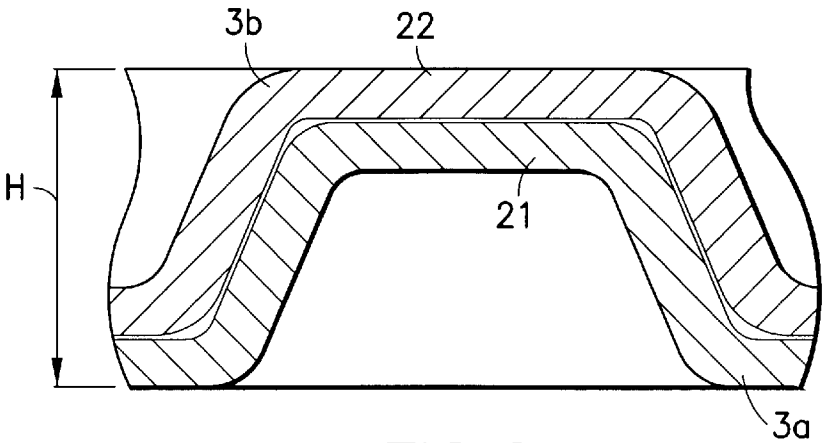
Figure 9:
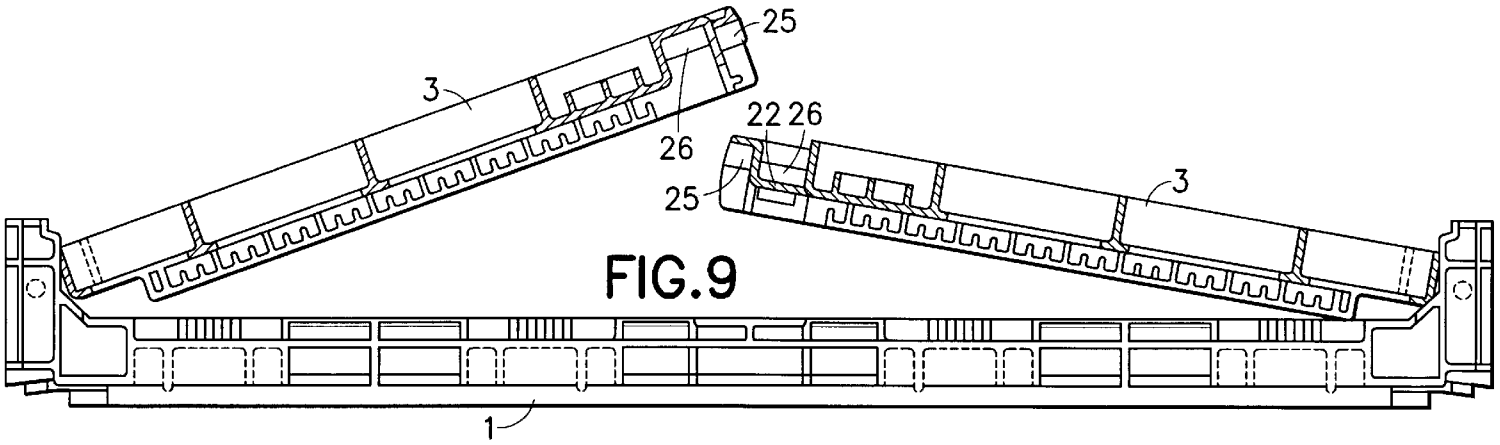
Figure 10:
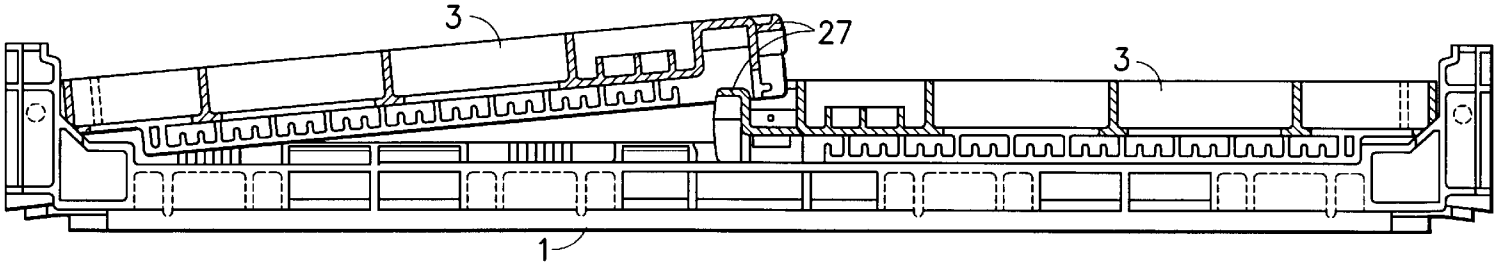
Figure 11:
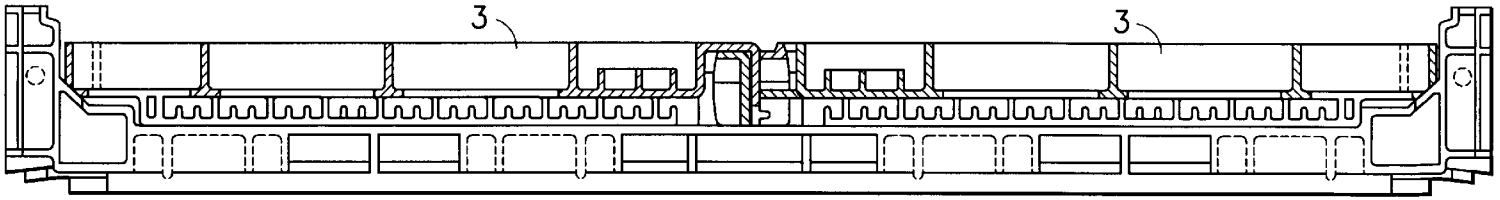

FIG. 5 shows a section through the side wall lying on top, in the overlapping region, FIG. 6 shows a section through the side wall lying underneath, in the overlapping region, FIG. 7 shows a section through the two overlapping side walls, in the overlapping region, FIG. 8 shows an enlargement of the detail X in FIG. 7, FIG. 9 shows a vertical section through a second exemplary embodiment with side walls partially collapsed, FIG. 10 shows the exemplary embodiment according to FIG. 9, with side walls just before the horizontal position of the two walls is reached, FIG. 11 shows the exemplary embodiment according to FIG. 9, with side walls resting horizontally on each other.

DETAILED DESCRIPTION

The folding container has a bottom plate with a narrow side and a long side. The bottom horizontal edge of each side wall is respectively hinged to each of these four sides in such a way that the four side walls can fold inward onto the bottom plate 1. In this connection, the side walls of the narrow end are folded down first and then the side walls 3 of the long side are folded down over them. When the container is erected, then in the reverse order, first the side walls 3 of the long sides are folded upward, followed by the side walls of the narrow side. When the side walls of the narrow end are folded upward, the vertical side edges of these side walls, in their vertical position, come into contact with vertical catch strips 4, which project inward on the vertical edges of the side walls 3. In so doing, a vertical edge region of the side wall 2 rests against the catch strip 4 of the side wall 3.

So that the side walls achieve a secure hold in relation to one another, projections 6 on the catch strip 4 protrude horizontally and engage in recesses of the edge region of the other side wall. The edge region in turn has projections that engage in recesses 7 of the catch strip 4. In this instance, the projections and recesses in the edge region are of the same shape and size as those in the catch strip 4.

When collapsed, the two side walls 3*a*, 3*b* of the long sides overlap partially. These reciprocally overlapping regions 3*c*, 3*d* are so formed that the overlapping regions 3*c*, 3*d* engage in each other and produce an overall height H that is no greater than or not significantly greater than the thickness of one side wall.

This is achieved by virtue of the fact that the top side of the overlapping region 3*c* of the side wall 3*a* has projections 21 and recesses 22 alternating at regular intervals, in particular in a wave form. The underside of the overlapping region 3*d* of the side wall 3*b*, though, is correspondingly formed conversely so that it engages, in particular with positive fit, in the top side of the lower wall 3*a*. The projections 21 and recesses 22 here, in particular the waves, can be formed so they are rounded or angled-off.

So that the catch strip 4 of the upper side wall 3*b* does not strike against the catch strip 4 of the lower side wall 3*c*, the catch strip 4 of the lower side wall 3*c* is disposed offset inward by the amount or interval g. In the exemplary embodiment, this dimension g corresponds approximately to the thickness of the wall of the strip 4.

Also for this purpose, the base plate has recesses into which the catch strips 4 of the side walls 3 can penetrate so that the side walls 3 can be folded down low enough.

The exemplary embodiment according to FIGS. 9 to 11 differs from the previous one, among other things, by virtue of the fact that the projections 21 and recesses 22 are not wave-shaped, or are only partially so, and that the upper horizontal stacking rim 25 of the side wall constitutes a large, in particular continuously extending, support surface for a second container disposed above this one.

The projections 21 have the shape of strips that rest in pocket-shaped and/or slot-shaped cavities/recesses 22 of the other side wall. In this instance, the projections constitute the upper support surface for a container disposed above this one. Support ribs 26 are disposed between the projections and run laterally to them. When the side walls are resting on each other, these support ribs rest in slots formed in the projections, in particular in the strips of the other side wall. Stacking boundaries are designated by 27.

What is claimed is:

1. A folding container with four vertical side walls (2, 3), which are hinged to a bottom plate (1) and are pivotable inward into a horizontal orientation, characterized in that in their horizontal position, two opposing side walls (3) overlap each other partially and the overlapped region (3*c*) of the side wall (3*a*) lying underneath has projections and recesses (21, 22) on its upper side, and the overlapping region (3*d*) of the side wall (3*b*) lying above is correspondingly shaped on its underside in such a way that the total thickness of the two regions overlapping each other corresponds to the thickness of one side wall.

2. The folding container according to claim 1, characterized in that said overlapped and overlapping regions (3*c*, 3*d*) engage in each other with positive fit.

3. The folding container according to claim 2, characterized in that support ribs (26) are disposed between the projections and run laterally to them and, when the side walls are resting on each other, these support ribs rest in slots formed in the projections of the other side wall.

4. The folding container according to claim 2, characterized in that the projections and recesses (21, 22) are wave-shaped.

5. The folding container according to claim 2, characterized in that on the vertical edge of an erected side wall (3), a vertical catch strip (4) projects inward and the vertical outside edge of the neighboring side wall comes into contact with the inside of this vertical catch strip, and that the catch strip (4) is disposed offset in relation to the vertical edge in such a way that the catch strip (4) forms a space (g) in relation to the vertical edge and this space corresponds to at least the wall thickness of the catch strip.

6. The folding container according to claim 1, characterized in that the projections are strip-shaped and rest in slot-shaped cavities of the other side wall.

7. The folding container according to claim 6, characterized in that support ribs (26) are disposed between the projections and run laterally to them and, when the side walls are resting on each other, these support ribs rest in slots formed in the projections of the other side wall.

8. The folding container according to claim 6, characterized in that the projections and recesses (21, 22) are wave-shaped.

9. The folding container according to claim 6, characterized in that on the vertical edge of an erected side wall (3), a vertical catch strip (4) projects inward and the vertical outside edge of the neighboring side wall comes into contact with the inside of this vertical catch strip, and that the catch strip (4) is disposed offset in relation to the vertical edge in such a way that the catch strip (4) forms a space (g) in relation to the vertical edge and this space corresponds to at least the wall thickness of the catch strip.

10. The folding container according to claim 6, characterized in that when the side wall is erected vertically, the projections on the upper horizontal edge (25) of the side wall form horizontal support surfaces for a second container disposed above said folding container.

11. The folding container according to claim 10, characterized in that support ribs (26) are disposed between the projections and run laterally to them and, when the side walls are resting on each other, these support ribs rest in slots formed in the projections of the other side wall.

12. The folding container according to claim 10, characterized in that the projections and recesses (21, 22) are wave-shaped.

13. The folding container according to claim 10, characterized in that on the vertical edge of an erected side wall (3), a vertical catch strip (4) projects inward and the vertical outside edge of the neighboring side wall comes into contact with the inside of this vertical catch strip, and that the catch strip (4) is disposed offset in relation to the vertical edge in such a way that the catch strip (4) forms a space (g) in relation to the vertical edge and this space corresponds to at least the wall thickness of the catch strip.

14. The folding container according to claim 1, characterized in that support ribs (26) are disposed between the projections and run laterally to them and, when the side walls are resting on each other, these support ribs rest in slots formed in the projections of the other side wall.

15. The folding container according to claim 14, characterized in that the projections and recesses (21, 22) are wave-shaped.

16. The folding container according to claim 14, characterized in that on the vertical edge of an erected side wall (3), a vertical catch strip (4) projects inward and the vertical outside edge of the neighboring side wall comes into contact with the inside of this vertical catch strip, and that the catch strip (4) is disposed offset in relation to the vertical edge in such a way that the catch strip (4) forms a space (g) in relation to the vertical edge and this space corresponds to at least the wall thickness of the catch strip.

17. The folding container according to claim 1, characterized in that the projections and recesses (21, 22) are wave-shaped.

18. The folding container according to claim 1, characterized in that on the vertical edge of an erected side wall (3), a vertical catch strip (4) projects inward and the vertical outside edge of the neighboring side wall comes into contact with the inside of this vertical catch strip, and that the catch strip (4) is disposed offset in relation to the vertical edge in such a way that the catch strip (4) forms a space (g) in relation to the vertical edge and this space corresponds to at least the wall thickness of the catch strip.

19. The folding container according to claim 18, characterized in that in a collapsed configuration, a catch strip (4) of the opposing side wall rests in a space (g) formed by the catch strip (4).

20. The folding container according to claim 18, characterized in that the bottom plate has recesses for the catch strip(s) (4) in the collapsed configuration.

* * * * *